United States Patent [19]

Zike

[11] 4,148,169

[45] Apr. 10, 1979

[54] TURRET BAGGER

[75] Inventor: Donald R. Zike, Yakima, Wash.

[73] Assignee: Pomona Service & Supply Co., Inc., Yakima, Wash.

[21] Appl. No.: 815,706

[22] Filed: Jul. 14, 1977

[51] Int. Cl.[2] ..... B65B 43/28

[52] U.S. Cl. ..... 53/573; 53/384

[58] Field of Search ..... 53/187, 188, 189, 190, 53/272, 276, 277, 278, 279, 280, 384, 385, 386

[56] References Cited

U.S. PATENT DOCUMENTS

| | | | |
|---|---|---|---|
| 2,054,279 | 9/1936 | Briggs | 53/384 X |
| 2,691,476 | 10/1954 | Petrea | 53/187 |
| 2,722,358 | 11/1955 | Wilson | 53/188 X |
| 3,478,844 | 11/1969 | Beuchle | 188/18 A |
| 3,789,573 | 2/1974 | Crabb | 53/190 X |

*Primary Examiner*—Travis S. McGehee

*Attorney, Agent, or Firm*—Robert W. Beach; Ward Brown

[57] ABSTRACT

An automatic bagging machine includes a bag-pickup station, a bag-filling station and a bag-tying station spaced equidistant from one another circumferentially around an orbit. A vertical shaft positioned centrally of such stations supports a set of radially extending bag-holding and spreading arms over each of the stations. Drive mechanism incrementally rotates the central shaft to move each set of arms sequentially from the pickup station to the filling station, then to the tying station and back to the pickup station. Control mechanism actuates the arms to pick up and spread a bag at the pickup station, grip and maintain the bag open for filling at the filling station, close the filled bag for tying at the tying station, release the filled and tied bag over a discharge conveyor and move the arms into position for picking up another bag at the pickup station. The drive mechanism also reciprocates a lower arm between the filling and tying stations for steadying each filled bag while it is being moved between such two stations. Brake mechanism is provided to decelerate the holding and spreading arms as they approach a bagging machine station.

10 Claims, 10 Drawing Figures

TURRET BAGGER

BACKGROUND OF THE INVENTION

1. Field of the Invention

The present invention relates to automatic bagging machines.

2. Prior Art

U.S. Pat. No. 3,789,573 issued to Jasper R. Crabb discloses an automatic bagging machine including one set of bag-holding and spreading arms which set is reciprocated between a station where bags are picked up and filled and a station where bags are tied. The problems with that bagging machine are: only one set of reciprocating arms is provided so that the pickup and filling station remains idle while a picked-up and filled bag is being moved to the tying station, while such bag is being tied at the tying station and while the arms are being moved back to the pickup and filling station; no auxiliary mechanism is provided to guide articles into a bag which has been spread at the pickup and filling station; and no mechanism is provided for steadying a filled bag as it is moved from the pickup and filling station to the tying station. Consequently, the bagging machine of U.S. Pat. No. 3,789,573 is slow in that: both stations are not active at the same time; rapid insertion of articles into a spread bag is not possible; and a filled bag must be moved slowly from the pickup and filling station to the tying station to deter violent swaying.

SUMMARY OF THE INVENTION

It is the principal object of the present invention to provide an automatic bagging machine which sequentially picks up, fills and ties bags rapidly.

Further to this object, it is an object to provide such a machine in which a plurality of stations for picking up, filling and tying bags perform their respective functions substantially simultaneously.

Further to the principal object, it is an object to provide auxiliary mechanism to spread bags at a bag-filling station and to guide articles into spread bags so that such bags may be filled rapidly.

Further to the principal object, it is an object to provide drive mechanism to shift bags quickly from one bagging machine station to another bagging machine station.

Further to the principal object, it is an object to provide mechanism for steadying a filled bag as it is moved from a bag-filling station to a bag-tying station.

Further to the principal object, it is an object to provide mechanism for decelerating holding and spreading arms as they approach a bagging machine station.

The foregoing objects can be accomplished by providing an automatic bagging machine including a bag-pickup station, a bag-filling station and a bag-tying station spaced from one another circumferentially around an orbit. Drive mechanism incrementally shifts each of several sets of bag-holding and spreading arms sequentially from the pickup station to the filling station, then to the tying station and back to the pickup station. Auxiliary spreading mechanism spreads bags at the filling station and guides articles into the spread bags. Steadying mechanism reciprocates between the filling station and the tying station and braking mechanism decelerates the holding and spreading arms as they approach each of the bagging machine stations.

DETAILED DESCRIPTION

Figure 1:
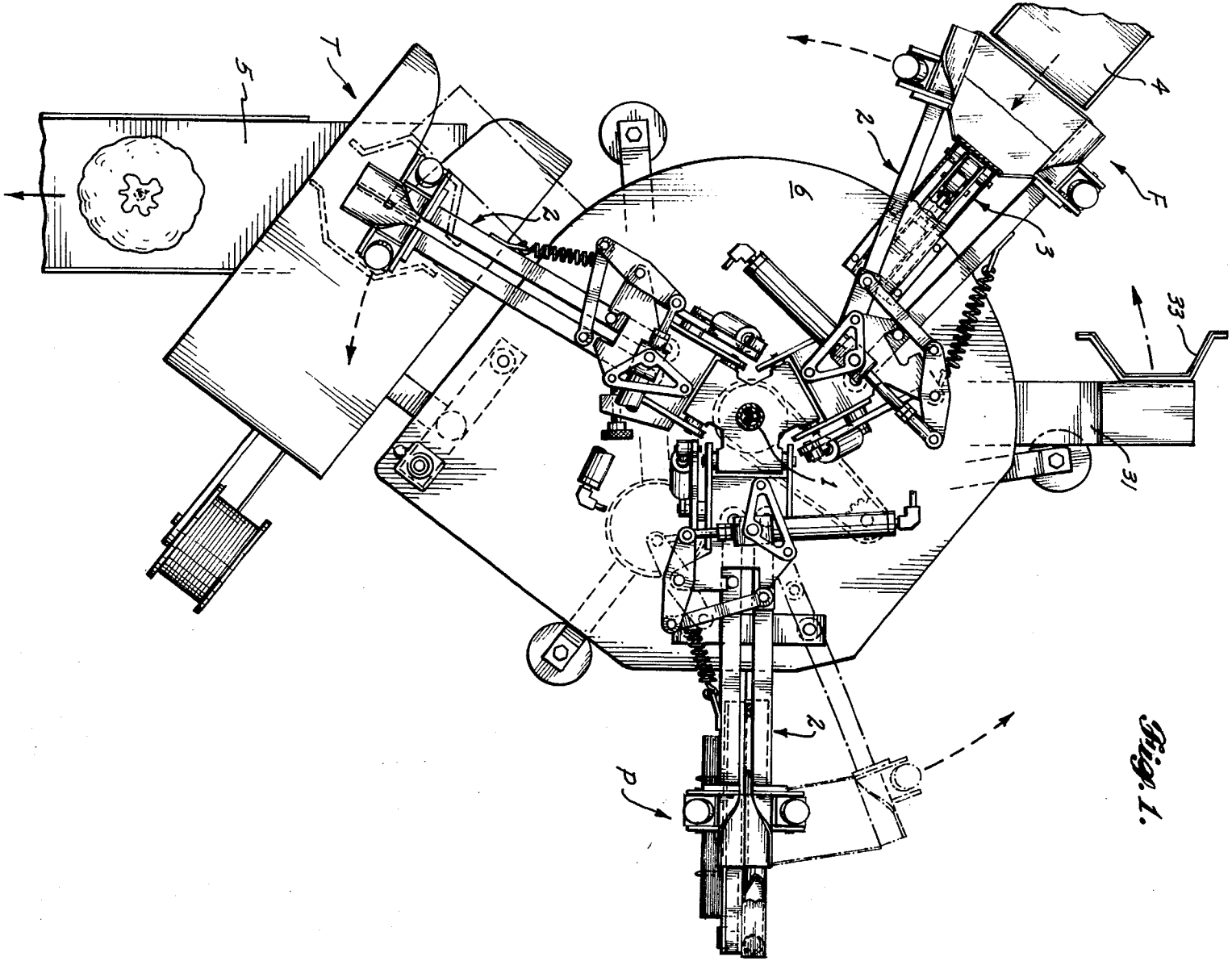
FIG. 1 is a plan of an automatic bagging machine in accordance with the present invention.

As shown in FIG. 1, an automatic bagging machine in accordance with the present invention includes a bag-pickup station P, a bag-filling station F, and a bag-tying station T spaced equidistant from one another circumferentially around an orbit. A central vertical shaft 1 carries a turret including several sets of radial bag-holding and spreading arms 2 spaced angularly to locate one set of such arms over each of the bagging machine stations. The construction of the pickup station is substantially identical to the construction of the "bag feeding mechanism" disclosed in U.S. Pat. No. 3,789,573. Further, the construction of each set of holding and spreading arms 2 is similar to the construction of the "bag holding mechanism" described in that patent in that each set includes rocking mechanism for vertical swinging about a horizontal axis. Bag-engaging spades carried by the swinging ends of such arms are lowered into the upper end of a bag partially opened by the bag feeding mechanism. Spreading mechanism performs spreading and closing operations, respectively, prior to and following the filling of a bag. Clamping mechanism includes leading and trailing clamping devices mounted on the bag-engaging spades for holding a bag. Each of the above features operates substantially as disclosed in U.S. Pat. No. 3,789,573. The construction of the tying station T may be substantially identical to the tying device disclosed in U.S. Pat. No. 3,789,573, but any other suitable tying device may be used. Further, the construction of filling station F does not constitute part of the present invention except for the auxiliary spreading and guiding mechanism which is further described below.

In accordance with the present invention, a set of bag-holding and spreading arms 2 picks up and spreads a bag at pickup station P. Central shaft 1 is rotated to shift such set of arms from the pickup station to filling station F. Auxiliary spreading mechanism 3 further spreads the picked-up bag and guides articles into such bag. For example, such articles may be supplied by a chute 4. The auxiliary spreading mechanism releases the bag, whereupon central shaft 1 is again rotated to shift the filled bag to tying station T where the bag is tied and dropped onto a discharge conveyor 5. Central shaft 1 is again rotated to shift the holding and spreading arms back to the pickup station. Since several sets of arms are provided, the bagging machine stations perform their respective functions substantially simultaneously, that is, while a bag is being picked up at station P, a bag which has already been picked up is being filled at station F and a bag which has been filled is being tied at station T.

Figure 2:
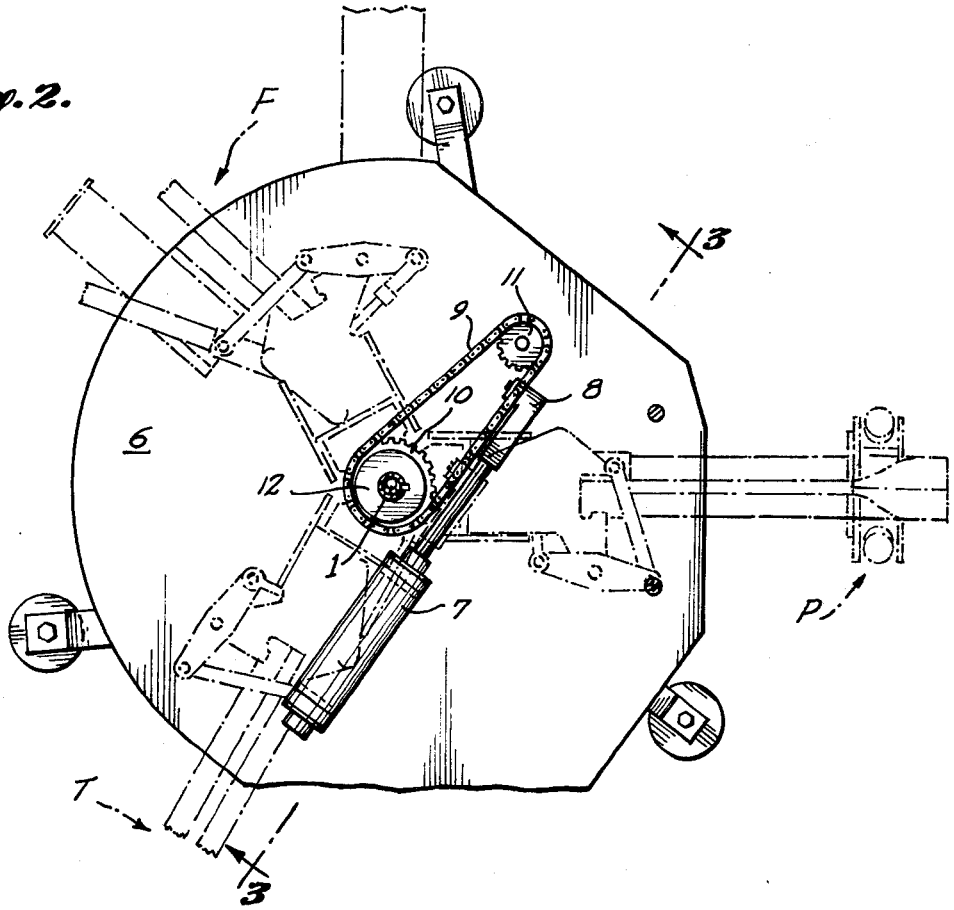
FIG. 2 is a detail of the drive mechanism of the bagging machine shown in FIG. 1, some parts being broken away.
Figure 3:
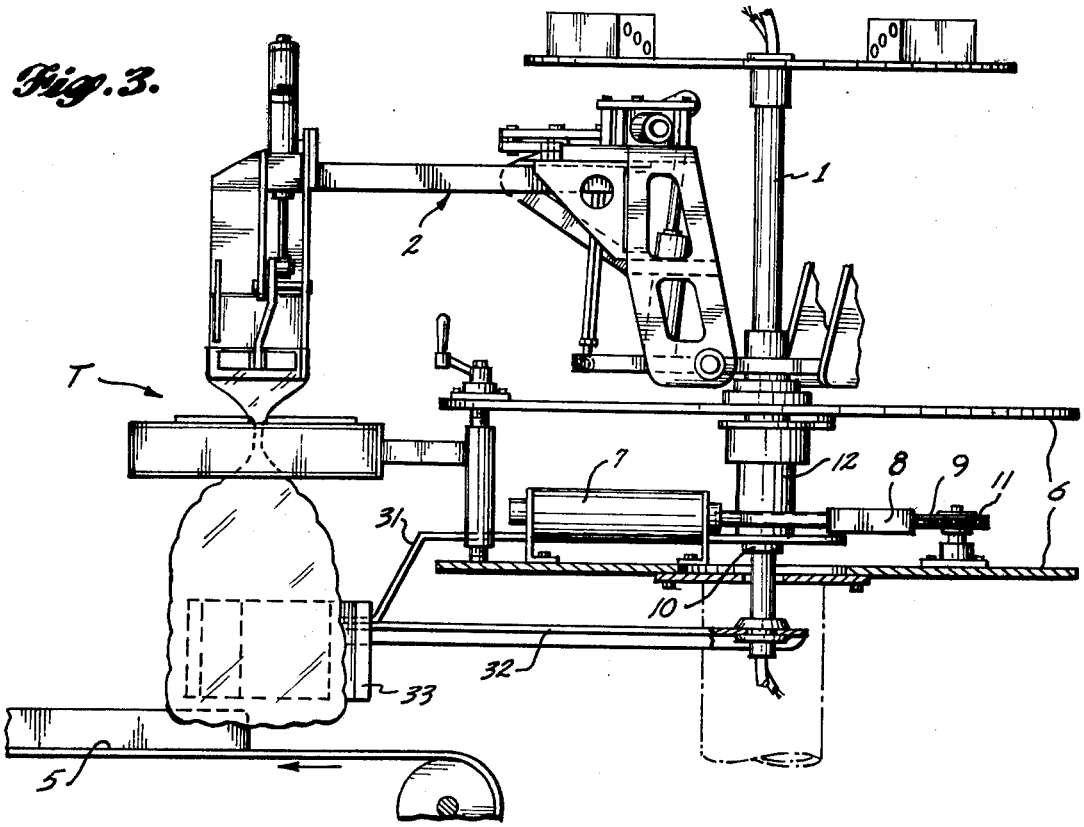
FIG. 3 is a section taken on line 3—3 of FIG. 2 with some parts broken away.

Drive mechanism for incrementally rotating central shaft 1 to rotate the turret and shift each set of holding and spreading arms from one station to the next station is shown in FIGS. 2 and 3. Suitable support structure 6 carries a pneumatic cylinder 7 which includes a reciprocating plunger 8. The plunger is attached to a chain 9 which connects central and outer sprockets 10 and 11, respectively. Conventional clutch mechanism 12 is provided to convert the reciprocating motion of central sprocket 10 into the unidirectional incremental turning of central shaft 1. Each time plunger 8 is extended from the dotted line position of FIG. 2 to the solid line position of that figure, the central shaft is rotated through an angle sufficient to shift each set of holding and spreading arms from one of the bagging machine stations to the next station. Each set of holding and spreading arms remains substantially stationary over one of the bagging machine stations as plunger 8 reciprocates back to its retracted position.

Figure 4:
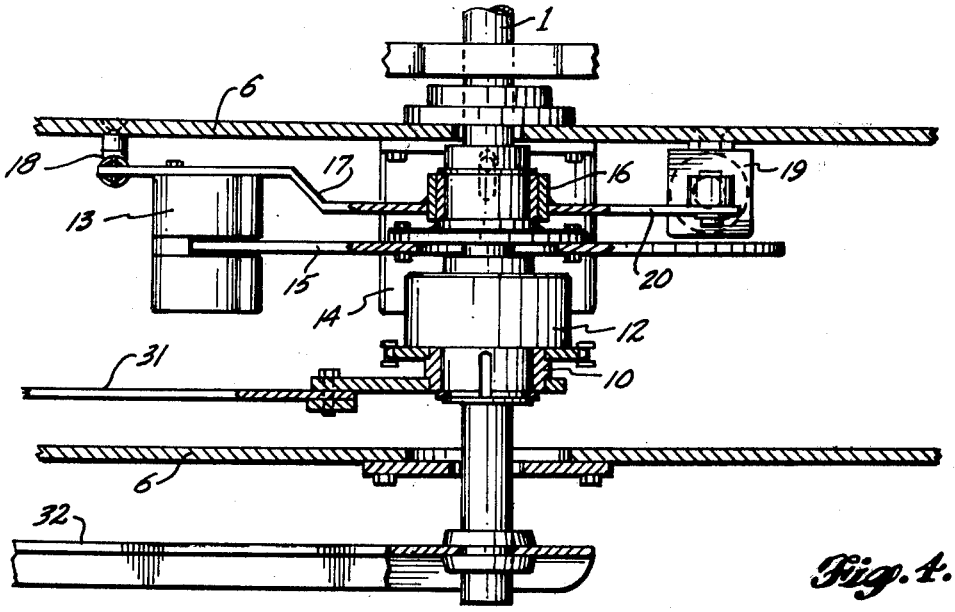
FIG. 4 is a detail elevation of an automatic bagging machine in accordance with the present invention including decelerating mechanism, some parts being shown in section and some parts being broken away.
Figure 5:
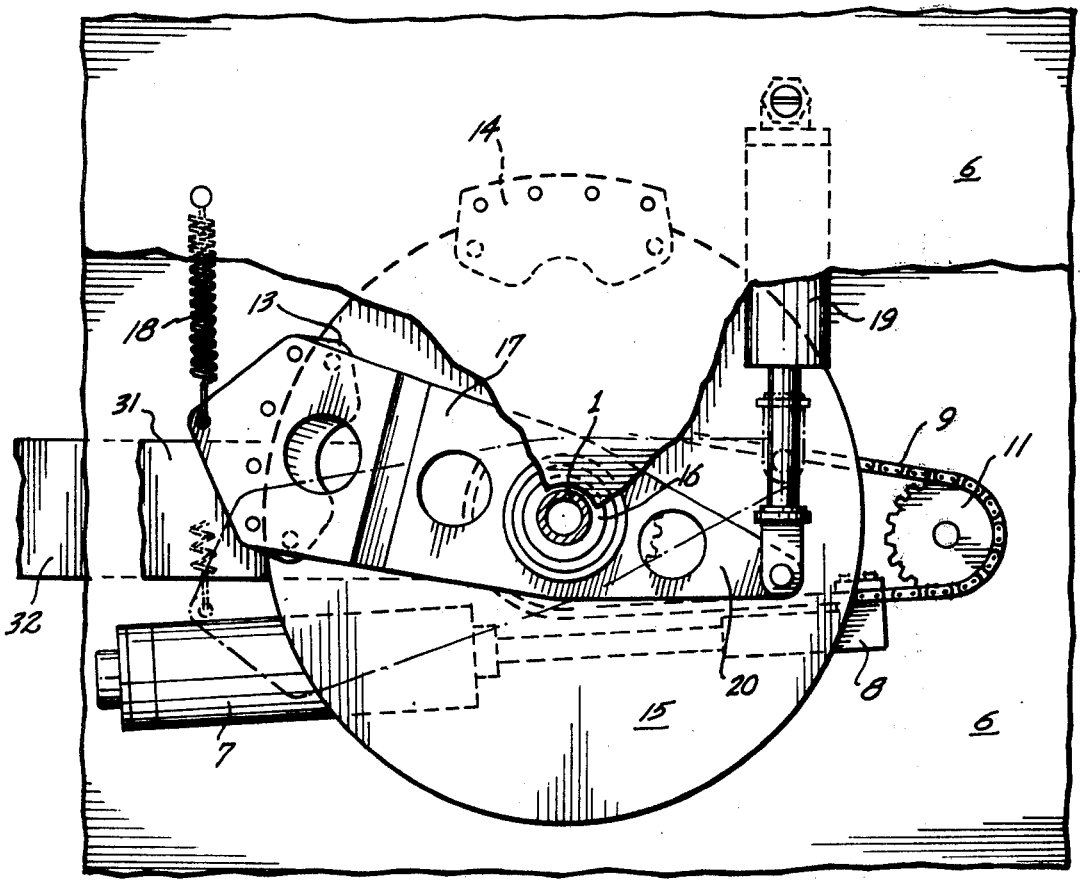
FIG. 5 is a plan of the bagging machine of FIG. 4, some parts being shown in section and some parts being broken away.

As seen in FIGS. 4 and 5, to decelerate the holding and spreading arms as they approach the various stations of the bagging machine, and to hold such arms stationary over the stations as plunger 8 is retracted, two caliper brakes 13 and 14 may be provided. Each brake is operable to grip a brake disk 15 carried by and rotated conjointly with central shaft 1 above clutch 12. Brake 14 is stationary because it is mounted on the bagging machine support structure. Brake 13 is mounted for swinging movement relative to the central shaft and the support structure by a collar 16 receiving the central shaft above brake disk 15, and a support arm 17 which extends radially outward from the collar. The degree of movement of brake 13 is limited by a resilient member, such as a spring 18 extending between the stationary bagging machine support structure and the outer end of support arm 17. Such movement is also limited by a shock absorber 19 connected between the bagging machine support structure and another arm 20 which extends radially outward from collar 16.

As each set of holding and spreading arms 2 nears a bagging machine station, brake 13 is actuatd to grip brake disk 15 firmly. Spring 18 and shock absorber 19 cooperate to decelerate the brake disk, the central shaft and the holding and spreading arms carried by the central shaft. When the holding and spreading arms are in position over the bagging machine station, brake 14 is actuated to hold the central shaft against rotation while plunger 8 is reciprocated back to its retracted position and while the picking up, filling and tying operations are being performed at the bagging machine stations.

Figure 6:
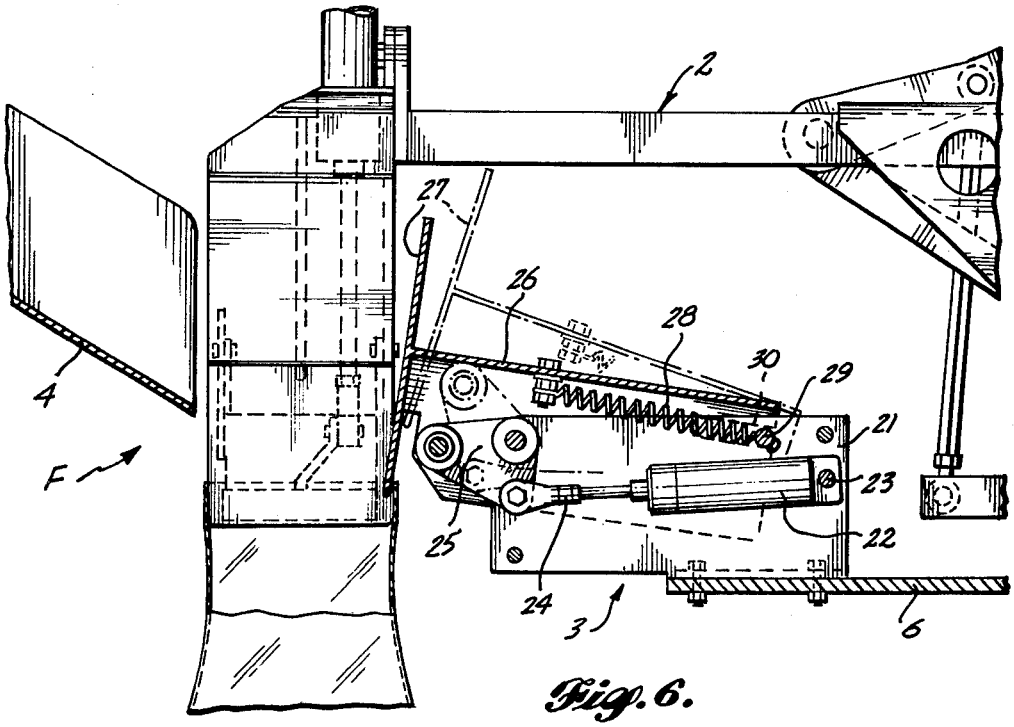
FIG. 6 is a detail elevation of the filling station of the bagging machine shown in FIG. 1 with some parts broken away and some parts shown in section.
Figure 7:
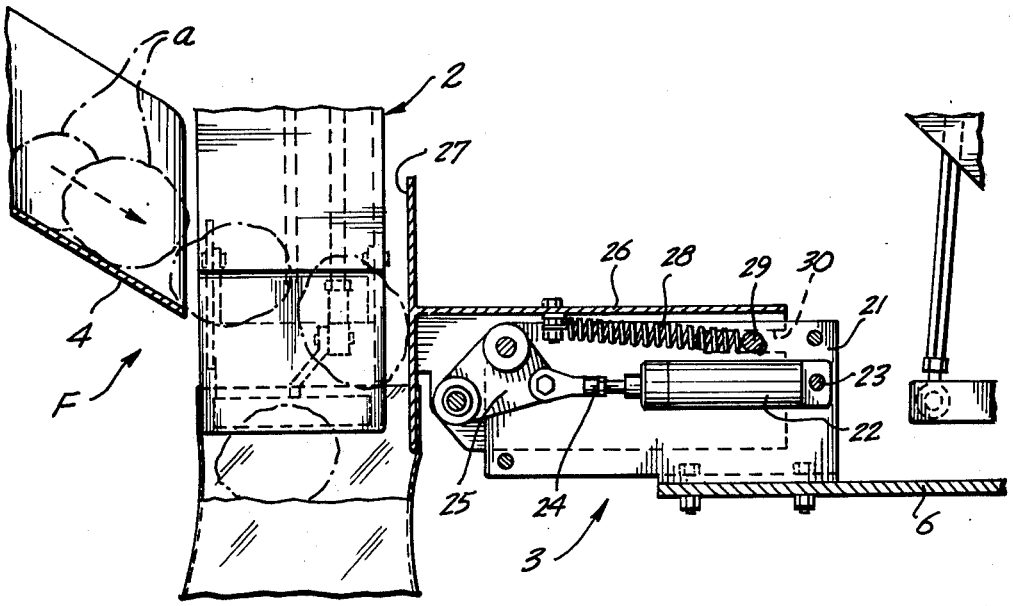
FIG. 7 is a corresponding detail showing parts in different positions.

As best seen in FIGS. 6 and 7, auxiliary spreading mechanism 3 is located at filling station F opposite article chute 4. Such mechanism is mounted on the bagging machine support structure 6 and includes a vertically extending support plate 21 located in a radial plane of the turret. The radially inner end of a pneumatic cylinder 22 is attached to the support plate by a horizontal pivot 23. Air in such cylinder drives a plunger 24 which is pivotally attached to one point of a bell crank 25. The other two points of the bell crank are pivotally attached, respectively, to the support plate and to a spreading and guiding member 26 which includes a generally vertical spreading and guiding face 27. A tension spring 28 is connected between spreading and guiding member 26 and a pin 29 extending from support plate 21. Such pin is received in a generally horizontal slot 30 in the radially inner end of the spreading and guiding member. The force of spring 28 on member 26 holds the slot against the pin to prevent clattering.

When plunger 24 is extended, as shown in dotted lines in FIG. 6, spreading and guiding member 26 is swung upward and inward out of the way of holding and spreading arms 2 which are advanced toward the filling station. When such arms are in position adjacent to the article chute, plunger 24 is retracted to swing the spreading and guiding member downward to hook the bag held by arms 2 and to draw the inner lip of the bag radially inward. Articles a may be rapidly discharged from chute 4 because the guiding face 27 of member 26 acts as a backstop to guide such articles into the spread bag. When the bag is full, plunger 24 is extended to swing spreading and guiding member 26 upward to release the bag and inward to the dotted line position of FIG. 6.

As described above, once the auxiliary spreading mechanism releases a filled bag, the holding and spreading arms are shifted to tying station T carrying the filled bag with them. Since it is desirable to shift the filled bag quickly, steadying mechanism, best seen in FIGS. 1 and 3, is provided. An upper support arm 31 extends radially of the turret outward from the central drive sprocket 10. A lower support arm 32 extends radially outward from the upright shaft carrying the drive sprocket. The outer end portions of the support arms carry a steadying hand 33 which is engageable with the filled bag. As drive mechanism plunger 8 is extended to shift a filled bag from the bag-filling station to the bag-tying station, the steadying hand follows the filled bag. As plunger 8 is retracted such hand is swung back behind the filling station to a position for following the next filled bag as it is shifted from the filling station to the tying station by extension of the plunger. Consequently, filled bags can be shifted quickly withut violent swinging.

Figure 8:
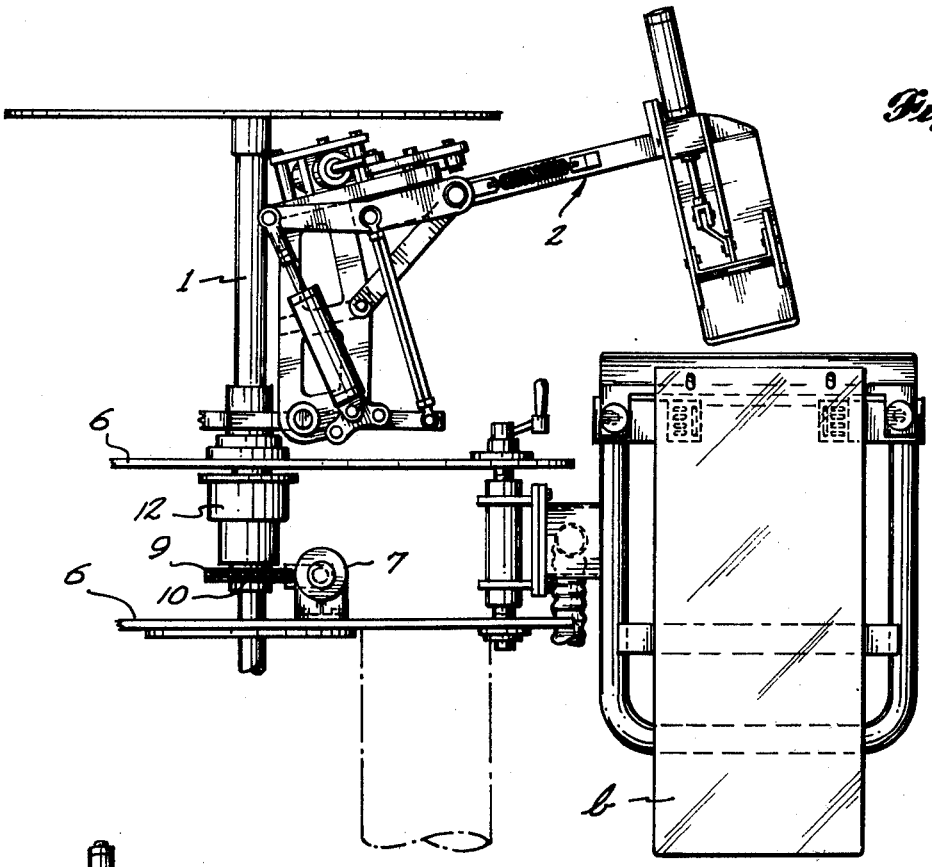
FIG. 8 is a side elevation of the pickup station of the bagging machine of FIG. 1, some parts being broken away.
Figure 9:
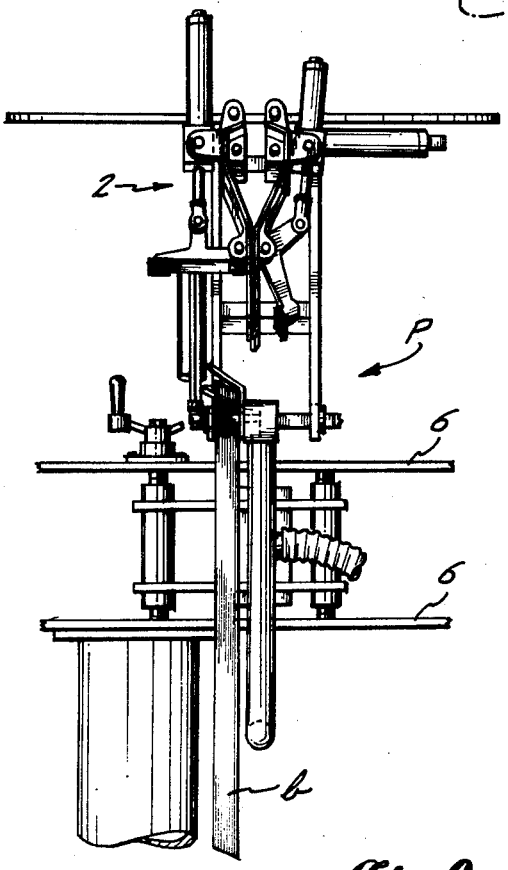
FIG. 9 is an end elevation of such pickup station, some parts being broken away.
Figure 10:
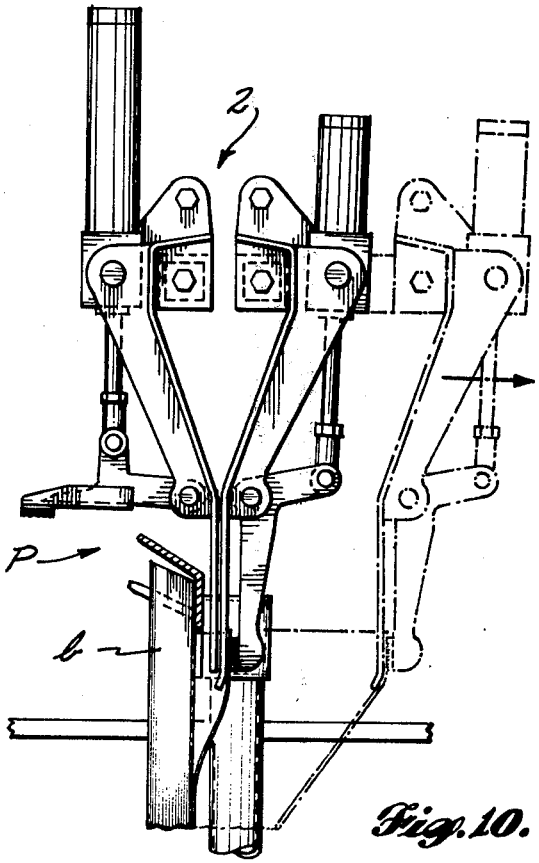
FIG. 10 is an enlarged detail end elevation of such pickup station showing parts in different positions.

Once a filled bag has been shifted to the tying station and tied, it is dropped onto discharge conveyor 5 and the holding and spreading arms are shifted to the pickup station. However, as best seen in FIGS. 8, 9 and 10, such arms must be lifted to clear the mechanism holding a pack of bags b. Suitable control mechanism, such as that described in U.S. Pat. No. 3,789,573, lowers the bag spreading arms into a partially opened bag, as shown in FIG. 10, and such bag is ready for spreading and shifting to the filling station.

A bagging machine in accordance with the present invention will pick up, fill and tie bags more rapidly than known machines because separate pickup, filling and tying stations are provided, and all of the stations perform their respective functions at the same time. Further, the bagholding and spreading arms may be swung quickly because the braking mechanism decelerates the arms as they approach a bagging machine station and because filled bags are steadied as they are shifted from the filling station to the tying station. In addition, the filling operation can be accomplished almost as quickly as the pickup or tying operation because auxiliary spreading and guiding mechanism is provided.

I claim:

1. In an automatic bagger including a bag-pickup station for supplying bags;

a bag-tying station spaced from the bag-pickup station for tying bags;

a bag-filling station located between the bag-pickup station and the bag-tying station for filling bags;

bag-holding and spreading means for picking up a bag at the bag-pickup station and for spreading the top opening of such picked-up bag;

unidirectional orbiting means carrying the baghold-ing and spreading means; and drive means for shifting the unidirectional orbiting means, after a bag has been picked up, from the bag-pickup station to the bag-filling station, where such picked-up bag is filled, and then to the bag-tying station, where such filled bag is tied;

the improvement comprising steadying means for following a filled bag and disposed in steadying engagement therewith while such bag is being shifted from the bag-filling station to the bag-tying station, and means for reciprocating said steadying means between the bag-filling station and the bag-tying station.

2. In the bagger defined in claim 1, the drive means shifting the bag-holding and spreading means from the bag-filling station to the bag-tying station while the reciprocating means is moving the steadying means from the bag-filling station to the bag-tying station, and the reciprocating means subsequently moving the steadying means in a direction generally opposite the direction of movement of the unidirectional orbiting means back from the bag-tying station to the bagfilling station.

3. An automatic bagger comprising:

a bag-pickup station for supplying bags;

a bag-filling station for filling bags;

a bag-tying station for tying bags, said bag-pickup station, bag-filling station and bag-tying station being spaced around an orbit;

bag-holding and spreading means for picking up a bag at said bag-pickup station and for spreading the top opening of such picked-up bag;

unidirectional orbiting means carrying said bag-holding and spreading means;

drive means for shifting said unidirectional orbiting means to move said bag-holding and spreading means, after a bag has been picked up, from said bag-pickup station to said bag-filling station, where such picked-up bag is filled, then to said bag-tying station, where such filled bag is tied and subsequently released by such bag-holding and spreading means, and then to said bag-pickup station to pick up another bag; and brake means for decelerating the bag-holding and spreading means as it approaches a bagger station including a brake disk rotatable conjointly with said orbiting means, a brake operable to engage frictionally said brake disk, means mounting said brake for movement relative to said orbiting means and resilient means for limiting the degree of movement of said brake.

4. In an automatic bagger including bag-holding means, a plurality of bagger stations and drive means for shifting the bag-holding means from one bagger station to another bagger station, the drive means including a rotatable drive shaft, the improvement comprising arresting means for decelerating the bag-holding means as it approaches one of the bagger stations, said arresting means including a movable member rotatable conjointly with the drive shaft, a cooperating member operable to engage said movable member, means mounting said cooperating member for movement with said movable member when said cooperating member engages said movable member, and resilient means for limiting the degree of movement of said cooperating member with said movable member.

5. In an automatic bagger including a bag-filling station, a plurality of bag-holding members each for holding a bag at the bag-filling station and drive means for shifting each bag-holding member orbitally in one direction away from the bag-filling station after the bag held by such member has been filled, the improvement comprising steadying means for following a filled bag moving in such one direction and disposed in steadying engagement therewith while such bag is being shifted away from the bag-filling station in such direction, and means for returning the steadying means to the bag-filling station in the direction generally opposite such one direction to follow and steady the next filled bag held by another of the bag-holding members.

6. In an automatic bagger including stationary support structure, a bag-filling station at one location of the support structure, bag-holding and spreading means for holding a bag at the bag-filling station and for spreading the top opening of such bag by engaging generally opposite portions thereof and moving such generally opposite portions apart, and drive means for shifting the bag-holding and spreading means relative to the support structure to the bag-filling station and for shifting the bag-holding and spreading means relative to the support structure away from such station after the bag held by such means has been filled, the improvement comprising auxiliary spreading means mounted on the stationary support structure at the bag-filling station for engaging an intermediate portion of the bag held at such station by the bag-holding and spreading means between such opposite portions engaged by such means, for pulling such intermediate portion outward and for releasing such intermediate portion of the bag before the drive means shifts the bag-holding and spreading means relative to the support structure away from the bag-filling station and said auxiliary spreading means.

7. In the bagger defined in claim 6, a plurality of bag-holding units, each unit having bag-holding and spreading means for holding a bag at the bag-filling station and for spreading the top opening of such bag by engaging generally opposite portions thereof and moving such generally opposite portions apart, the drive means shifting the bag-holding units successively to the bag-filling station and thereafter away from such station, the auxiliary spreading means being mounted on the stationary support structure at the bagfilling station independently of the bag-holding units.

8. In an automatic bagger including a bag-filling station, principal spreading means for spreading the top opening of a bag at the bag-filling station by engaging generally opposite portions thereof and moving such generally opposite portions apart and drive means for shifting the bag to the bag-filling station and for shifting the bag away from such station after it has been filled, the improvement comprising auxiliary spreading means at the bag-filling station for engaging an intermediate portion of the bag between such opposite portions engaged by the principal bag-spreading means and for pulling such intermediate portion outward, said auxiliary spreading means including a guide member for guiding articles into the spread opening of the bag as the bag is being filled.

9. In the bagger defined in claim 8, the auxiliary spreading means including means for inserting the guide member into the bag before it is filled and for removing the guide member from the bag after it is filled but before it is shifted away from the filling station.

10. In the bagger defined in claim 9, the guide member including a portion projecting above the top opening of the bag when the auxiliary spreading means are inserted into the bag.

* * * * *